US005325988A

United States Patent [19]

Ekern

[11] Patent Number: 5,325,988

[45] Date of Patent: Jul. 5, 1994

[54] INSULATED JACKET FOR BEVERAGE BOTTLE

[76] Inventor: Mark E. Ekern, 207 N. Prairie, Flandreau, S. Dak. 57028

[21] Appl. No.: 92,451

[22] Filed: Jul. 15, 1993

[51] Int. Cl.[5] ..... B65D 90/04

[52] U.S. Cl. ..... 220/411; 62/457.1; 62/457.4; 220/739

[58] Field of Search ..... 62/457.1, 457.2, 457.3, 62/457.4, 457.5, 371, 372, 529, 530; 220/739, 411, 412; 215/12.1; 403/291; 135/34.2, 25.41

[56] References Cited

U.S. PATENT DOCUMENTS 4,516,409 5/1985 Hobbs, Jr. et al. ..... 62/457.3
4,577,474 3/1986 Peterson ..... 62/457.4
4,580,412 4/1986 Wells ..... 62/372
4,871,597 10/1989 Hobson ..... 428/36.1

FOREIGN PATENT DOCUMENTS 1501244 10/1969 Fed. Rep. of Germany ..... 62/372

*Primary Examiner*—John M. Sollecito

[57] ABSTRACT

An insulated carrier for beverage bottles or cans composed of two pieces divided circumferentially. The pieces are held together by an elastic cord so that they can easily be removed from the container without being totally separated.

3 Claims, 1 Drawing Sheet

INSULATED JACKET FOR BEVERAGE BOTTLE

BACKGROUND OF THE INVENTION

This invention pertains to insulating devices intended for carrying cans or bottles of a beverage to keep the beverage either hot or cold.

Many devices have been used to carry beverages and to keep that beverage at or near a certain temperature. Vacuum bottles are an example of such a device which requires a decanting of the beverage into the container.

With the advent of standard sized cans or bottles, the use of jacket type devices adapted to surround the container has become more popular. Usually such device are made of a foamed insulation material and may cover only the bottom part of a can or bottle to insulate the container from the warmth of the hand of the person holding the container. Full jackets to enclose the can or bottle completely have been proposed, but nearly all of them are divided on an axial plane and use a hinge mechanism to hold two halves together.

By the present invention a jacket-type insulation device is provided. The jacket is divided circumferentially and uses an elastic cord fixed to both parts of the divided jacket to hold the parts together so that one part will not be mislaid, lost or forgotten.

DESCRIPTION

Figure 2:
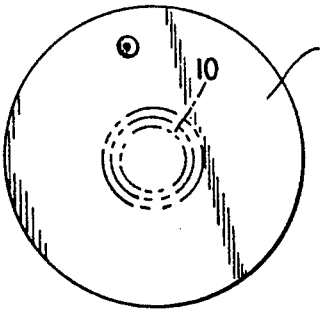
FIG. 2 is a top view of the device of FIG. 1.
Figure 1:
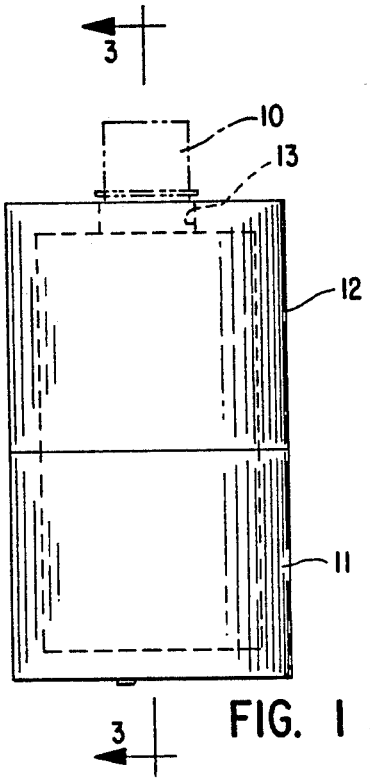
FIG. 1 is an elevational view of the insulator surrounding a bottle.
Figure 3:
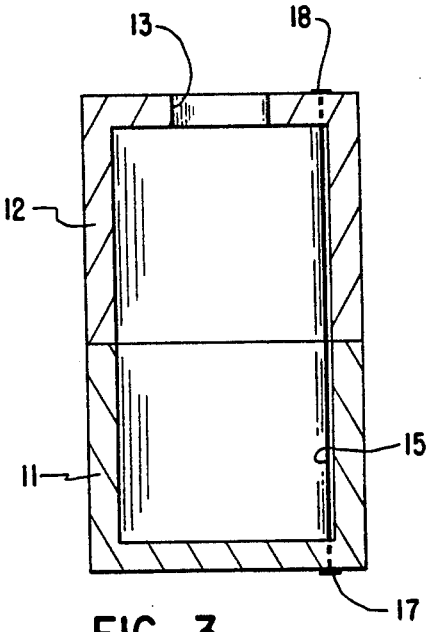
FIG. 3 is a sectional view from line 3—3 of FIG. 1.
Figure 4:
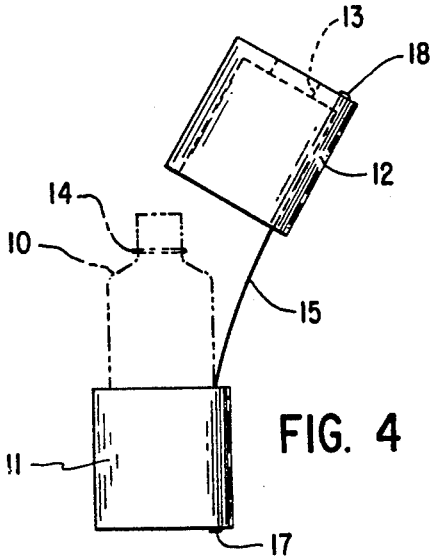
FIG. 4 is an elevation view to a reduced scale of the jacket being opened.

Briefly this invention comprises an insulated jacket for bottles or cans of beverage of a size customarily by a single user directly from that bottle or can. The jacket is such that part of it stays on the bottle or can while the beverage is consumed.

More specifically, the insulator is adapted to enclose a can or bottle 10 and is composed of a lower part 11 and an upper part 12, formed of foamed material so as to provide good insulation. The lower part is formed as a cup adapted to receive the lower portion of a can or bottle. This part may then be used as an insulated holder so that a cold beverage will not be warmed by the hand of the user.

The upper part 12 is made of the same material and may be formed with an opening 13 in the end to surround the neck 14 of an enclosed bottle. Thus, if a bottle is used, it will only be necessary to uncap the bottle to have the opening in place for someone to drink its contents. If the device is used on a can having a neck or similar top opening, the use would be the same. Only if a "flip-top" can were used will it be necessary to remove the upper half of the jacket. In that situation, there is a tendency to set the top part 12 aside where it may be inadvertently left or forgotten.

In order to prevent such inadvertence, a retaining device may be used. The preferred retainer is an elastic cord 15. The cord 15 in order to be stretched enough to allow the upper part 12 to be removed over the tip of the container 10 must be fairly long. It has been found that a cord fastened to the bottom of the lower part 11 as at 17 and at the top of the upper part 12 as at 18 works very well. This cord 15 should be relaxed but not slack in its proper position.

By using the cord 15, the insulator is never completely separated but is still very useful even when the beverage in the container is being drunk.

I claim:

1. An insulation jacket for a beverage container comprising a lower cup-shaped portion formed to receive the lower part of said container and an upper portion formed to fit the upper portion of said container, both of said portions being formed of a foamed insulating material, said upper portion and lower portions being connected by an elastic retaining cord having two ends with each respective end attached to one of said upper and lower portion.

2. The insulating jacket of claim 1 in which said cup-shaped lower portion has an enclosed bottom and said upper portion has a top, said retaining cord being normally wholly contained within said upper and lower portions and being fastened between said bottom and said top.

3. The insulating jacket of claim 2 in which said retaining cord has a normal relaxed length approximately equal to the distance between said bottom and said top when assembled, said cord being of sufficient elasticity to stretch to at least one and one-half times its normal length, said bottom and said top having a substantially equal axial length.

* * * * *